United States Patent [19]

Kobayashi et al.

[11] Patent Number: 4,666,764

[45] Date of Patent: May 19, 1987

[54] ANTISTATIC POLYESTER FABRIC HAVING WATER REPELLENCY

[75] Inventors: Shigenobu Kobayashi, Toyonaka; Fumiki Takabayashi, Takatsuki; Setsuo Yamada, Ibaraki, all of Japan

[73] Assignee: Teijin Limited, Osaka, Japan

[21] Appl. No.: 832,739

[22] Filed: Feb. 24, 1986

[30] Foreign Application Priority Data

Feb. 25, 1985 [JP] Japan ..... 60-34583

[51] Int. Cl.[4] ..... B32B 7/00

[52] U.S. Cl. ..... 428/254; 428/265; 428/398

[58] Field of Search ..... 428/265, 254, 398

[56] References Cited

U.S. PATENT DOCUMENTS 4,605,587 8/1986 Thomas et al. ..... 428/265

*Primary Examiner*—Marion C. McCamish

*Attorney, Agent, or Firm*—Burgess, Ryan & Wayne

[57] ABSTRACT

An antistatic polyester fabric having a water repellency, which comprises a woven or knitted fabric comprising a fiber of a modified polyester composed mainly of a polyester and blended with an antistatic agent, at least the surface of which is covered with a fluorine type water and oil-repellency agent.

9 Claims, No Drawings

ANTISTATIC POLYESTER FABRIC HAVING WATER REPELLENCY

BACKGROUND OF THE INVENTION (1) Field of the Invention

The present invention relates to a water-repellent antistatic polyester fabric having a durable antistatic effect and a durable water repellency in combination.

(2) Description of the Related Art

Trials to impart an antistatic property to a synthetic fiber woven or knitted fabric have been made for many years. For example, in U.S. Pat. No. 2,694,688, there is proposed a method in which a film of a hydrophilic polymer having an antistatic effect is formed on the surface of a fiber, and Japanese Examined Patent Publication (Kokoku) No. 59-34818 discloses a method in which a hydrophilic monomer is polymerized on the surface of a fiber.

On the other hand, there is well known a method in which a water repellency is imparted by covering the surface of a fiber with a fluorine type polymer (see, for example, U.S. Pat. No. 3,378,609). More specifically, a solvent solution or aqueous emulsion of a fluorine-containing polymer is applied to a woven or knitted fabric, drying the woven or knitted fabric and, if necessary, heat treating the fabric to form a film of the fluorine containing polymer on the fiber surface.

Recently, an antistatic agent is used in combination with a fluorine type polymer as described above for obtaining a woven of knitted fabric having both the functions. However, since an antistatic generally has a strong hydrophilic characteristic contradictory to the water-repellent effect, and it is difficult to maintain both the properties at satisfactory levels. Even though both the properties are temporarily satisfactory, in ordinary water-repellent and antistatic processed products, the antistatic effect or both the water-repellent and antistatic effects are lost by washing or dry cleaning.

SUMMARY OF THE INVENTION

It is the primary object of the present invention to solve the above-mentioned problem involved in the conventional techniques and provide an antistatic polyester fabric having a water repellency durable to repeated washing.

The present invention, thus, provides an antistatic polyester fabric having a water repellency, which comprises a fabric comprising a fiber of a modified polyester composed mainly of a polyester and blended with an antistatic agent, at least the surface of which is covered with a fluorine type water and oil repellency agent.

DESCRIPTION OF THE PREFERRED EMBODIMENTS

An example of the production of the modified polyester fiber usable for the present invention will now be described.

As the polyester as the base of the modified polyester fiber, there can be mentioned polyalkylene terephthalates and polyalkylene napthalates. Especially, the former polyester, that is, a polyester containing terephthalic acid as the main acid component and at least one glycol selected from alkylene glycols having 2 to 6 carbon atoms, such as ethylene glycol and hexamethylene glycol, as the main glycol component may be used. The process for the preparation of a polyester as described above is not particularly critical. For example, polyethylene terephthalate can be easily prepared by forming a glycol ester of terephthalic acid and/or an oligomer by direct esterification between terephthalic acid and ethylene glycol, transesterification reaction of a lower alkyl ester of terephthalic acid such as dimethyl terephthalate with ethylene glycol or reaction between terephthalic acid and ethylene oxide, and subjecting the product to polycondensation under reduced pressure by heating until a desired polymerization degree can be obtained.

A part of the terephthalic acid of the polyester may be substituted by other functional acid. For example, there can be mentioned bifunctional aromatic carboxylic acids such as isophthalic acid, phthalic acid, dibromoterephthalic acid, naphthalene-dicarboxylic acid, diphenyl-dicarboxylic acid, hydroxyethoxybenzoic acid and p-hydroxybenzoic acid, bifunctional aliphatic acids such as sebacic acid, adipic acid and oxalic acid, and bifunctional alicyclic carboxylic acids, such as 1,4-cyclohexane dicarboxylic acid. A part of the glycol component may be substituted by other glycol. For example, there can be mentioned aliphtic alicyclic and aromatic diol compounds such as cyclohexane-1,4-dimethanol, neopentyl glycol, bisphenol A, bisphenol S and 2,2-bis(3,5-dibromo-4-(2-hydroxyethoxy)-phenylpropane. Furthermore, a product formed by melt-blending a small amount of other polymer into the above-mentioned polyester is included in the scope of the polyester referred to in the present invention.

A composition formed by incorporating a polyalkylene glycol as the antistatic agent and an ionic antistatic agent into the above-mentioned polyester can be mentioned as an example of the polyester used in the present invention. It is indispensable that the polyoxyalkylene glycol should have no substantial reactivity with the above-mentioned polyester. By the term "no substantial reactivity" as used herein, it is meant that the polyoxalkylene glycol is not copolymerized with the polyester. If the polyalkylene glycol has a reactivity with the polyester, the control of compounding becomes difficult.

As the polyoxyalkylene glycol, there are preferably used polyoxyalkylene glycol having an average molecular weight of at least 6,000, especially at least 10,000, and a polyalkylene glycol comprising oxyethylene units as main units (ordinarily at least 50%) and, for example, oxypropylene units. The terminals of the polyoxyalkylene glycol may be hydroxyl groups, blocked by non-ester-forming organic groups of bonded to other ester-forming groups through an ether linkage, or an ester linkage or carbonate linkage. In the case where the terminals are blocked by non-ester-forming organic groups, the average molecular weight of the polyoxyalkylene glycol may be as low as about 800 to about 4,000. The content of the polyoxyalkylene glycol in the polyester may preferably be at most 2% by weight, more preferably at most 1% by weight.

An ionic antistatic agent is used in combination with the above-mentioned polyoxyalkylene glycol. As the ionic antistatic agent, there can be mentioned anionic antistatic agents, cationic antistatic agents and mixtures thereof, such as polyethylene glycol, polybutylene glycol, alkyl-(or aryl- or alkylaryl-)sulfonic acid metal salts, alkyl- (or arlyor alkylaryl-)amines and polyoxyalkylene-alkyl- (or arylor alkylaryl-)amines. Among them, an ionic antistatic agents having the group $-SO_3M$, especially alkyl-, aryl- or aralkyl-sulfonic acid metal salts represented by the general formula $RSO_3M$, in which M is an alkali metal such as sodium, potassium or lithium, especially sodium, and R is alkyl having at least 8 carbon atoms, aryl or alkylaryl in which the alkyl has at least 8 carbon atoms, are preferred. If the alkyl group in R has up to 7 carbon atoms, the compatability of the salts with the polyester is somewhat degraded. In general, the alkyl group may have 8 to 20 carbon atoms, and in many cases, the salts may be used as a mixture of salts in which the alkyl group is a mixture of alkyls having 8 to 20 carbon atoms. The content of the alkyl-, aryl- or alkylaryl-sulfonic acid metal salt in the polyester may preferably be at most 0.1%, especially at most 0.5% by weight.

In view of the physical properties of the resulting fiber, the total content of the polyoxyalkylene glycol and the ionic antistatic agent may preferably be adjusted to at most 3%, more preferably at most 1.5%, especially at most 1.2% by weight based on the weight of the polyester, and it is preferred that the mixing ratio by weight of both the components be such that the polyoxyalkylene glycol occupies 50 to 90% by weight of the total weight of both the components. The lower limit of the total content of both the components may be about 0.2% by weight. If the total content is below this lower limit, however, changed the mixing ratio of both the components may be, or however, changed the hollow ratio, as described hereinafter, of the fiber may be, the intended antistatic effect may not be attained.

A modified polyester fiber having a hollow portion continuous in the longitudinal direction may preferably be used as the modified polyester fiber in the present invention. It is preferred that the hollow ratio of the fiber be up to 15%, especially up to 4%. If the hollow ratio exceeds 15%, as shown in the examples given hereinafter, the fiber itself may easily be split into fibrils and the mechanical properties of the fiber may be drastically degraded. The outer shape of the fiber having such a hollow portion or the shape of the hollow portion is not particularly critical, so far as a polymer layer continuous in the direction of the fiber axis is present. For example, there may be mentioned a fiber having a circular outer shape and including a circular hollow portion, a fiber having a polygonal outer shape in which each side is inwardly convex and a circular hollow portion, a fiber having a non-circular outer shape and including a non-circular hollow portion, and a fiber having a plurality of hollow portions, for example, 2 to 4 hollow portions.

In the present invention, the term "fiber" is used to include filaments, staple fibers and twisted, textured and spun yarns thereof.

As the fluorine type water and oil-repellency agent preferably used in the present invention, there may be mentioned fluoroalkyl group-containing polymers, especially reactive polymers represented by the following general formula,

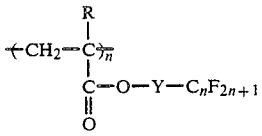

in which R is hydrogen or alkyl of 1 to 4 carbon atoms, Y is a radical containing alkylene of 1 to 6 carbon atoms, such as —R'—,

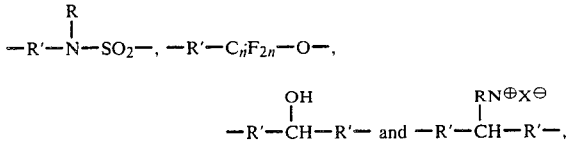

R' is alkylene of 1 to 6 carbon atoms, $X^-$ is an anion, and n is an integer of 1 to 30. As the example of the reactive polymers, the following compounds may be mentioned:

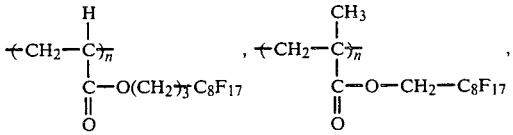

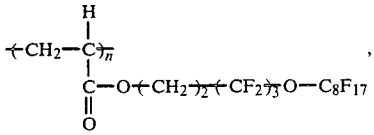

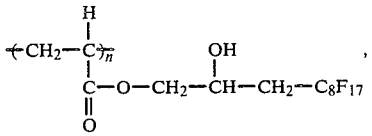

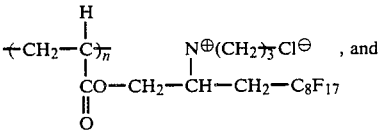

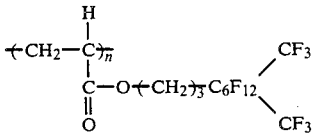

In the above formulae, n is as defined above. The above-mentioned reactive polymer may be used alone or as a mixture of two or more thereof. Furthermore, in the present invention, the water and oil-repellency agent is not limited to the above-mentioned polymer, and there can also be used copolymers of two or more of the monomers as used for the starting monomers of the above-mentioned reactive polymer, and copolymers of one or more of the monomers with one or more other comonomers such as vinyl chloride, vinylidene chloride, methacrylic acid, diacetone acrylamide, 2-ethylhexyl methacrylate, dodecyl methacrylate, glycidyl methacrylate and styrene.

In order to increase the durability of the water-repellent effect, a polyfunctional aziridine compound having two or more groups represented by the following formula,

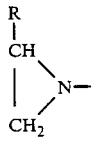

in which R is hydrogen or methyl, may be used in combination with the fluorine type water and oil-repellency agent. For example, the following compounds may be mentioned:

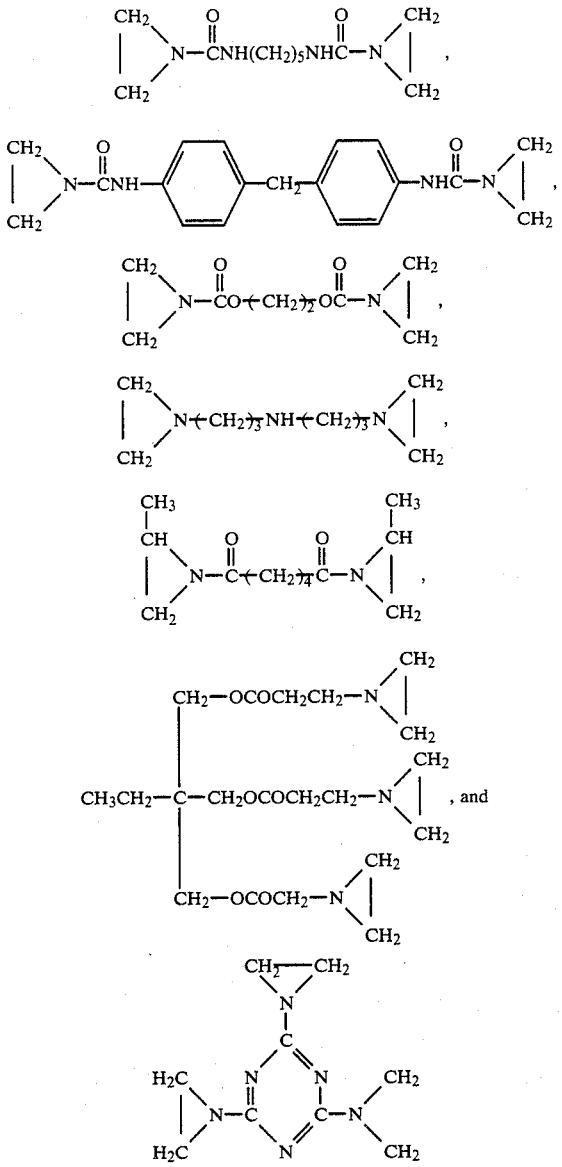

As means for applying the fluorine type water and oil-repellency agent, there may be adopted any of the conventional padding, coating and spraying methods. After application of the fluorine type water and oil-repellency agent, the fabric is dried and heat treated at a temperature not lower than 100° C., preferably of 150° C. to 190° C., for 30 seconds to 3 minutes. It is preferred that the amount of the fluorine type water and oil-repellency agent be 0.5 to 2.0% by weight as the active ingredient based on the weight of the fabric to be treated.

In the present invention, the fiber of the modified polyester may be used in combination with other fiber. Examples of the other fiber may include ultra-fine multifilament yarns and spun yarns. As the spun yarns, there may be mentioned those consisting of or containing ultra-fine fibers. The ultra-fine fibers including ultra-fine multifilaments and staple fibers may be made of polyesters, polyamides or polyolefins. Further, as the ultra-fine fibers, there may be employed split type composite fibers which are formed in the state that polyamide and polyester are alternately bonded in a filament and are then converted into ultra-fine fibers by splitting it into the respective component filaments at a later processing stage in the form of a yarn of fabric, and islands-in-a-sea type composite fibers which are converted into ultra-fine fibers by removing the sea component composed of a polymer such as a polystyrene polymer to retain only the islands component generally composed of polyamide, polyester or the like. In the case where the ultra-fine fibers are used as a multifilament yarn, they may be used alone or in combination. The ultra-fine fibers may preferably have individually a fineness of not more than 1.2 deniers, more preferably not more than 1.0 denier.

The ultra-fine fibers may be combined with the modified polyester fibers upon the formation of the fabric. For example, they may be combined by forming a mixed yarn of a modified polyester multifilament yarn and an ultra-fine multifilament yarn and then forming a fabric using the mixed yarn, or by forming a mixed woven or knitted fabric using a modified polyester multifilament yarn or a textured yarn obtained therefrom along with an ultra-fine multifilament yarn. The above-mentioned mixed yarn may be prepared by blending, intertwisting or intertwining the fibers together. Most preferably, the mixed yarn may be prepared by interlacing together a modified polyester multifilament yarn having a relatively high heat shrinkability and an ultra-fine multifilament yarn having a relatively low heat shrinkability. Then, the mixed yarn is converted into a fabric and the fabric is subjected to heat treatment to allow the surface of the mixed yarn covered with the ultra-fine fiber and produce fine irregularity on the fabric surface. In this case, the difference of the heat shrinkability between the modified polyester fiber and the ultra-fine fiber preferably ranges from 5 to 20%.

In the case of the intertwisted mixed yarn, there may be used a modified polyester multifilament yarn and an ultra-fine multifilament yarn having a heat shrinkability difference therebetween as mentioned above and further a textured ultra-fine multifilament yarn may be used as the ultra-fine multifilament yarn. By subjecting a fabric made from such an intertwisted mixed yarn to heat treatment, there can be easily obtained fabric wherein the surface of the mixed yarn is covered with the ultra-fine fibers and fine irregularity is appeared on the surface of the fabric.

In the case of the above-mentioned mixed woven fabric, the weave of the fabric is not particularly critical, and fabric of plain weaves, twill weaves, satin weaves and derivative weaves therefrom can be advantageously used. Woven fabrics of a high density are particularly preferred. As the mixed woven fabric, fabrics containing the modified polyester yarn as the warp and the ultra-fine yarn as the weft, or vice versa, and of double weaves can be advantageously used.

The fabric may be a double woven fabric or an interlock knitted fabric. Preferably, the fabric has one surface (e.g., front side) mainly composed of the ultra-fine fiber and the other surface (e.g., reverse side) mainly composed of the modified polyester fiber. For example, there may be mentioned a double woven fabric having a front side surface of a plain weave composed of the ultra-fine fiber and having a high density of a cover factor ranging from 1,400 to 3,400. Advantageously, such a fabric may have a reverse side surface having a cover factor of 1 to $\frac{1}{4}$ of that of the front side surface.

The cover factor K can be determined as the total of the cover factors of both the warp and weft, each of which is calculated by the following formula:

$$K = \sqrt{\text{denier of warp}} \times \text{density of warp per inch} + \sqrt{\text{denier of weft}} \times \text{density of weft per inch.}$$

A mixed woven or knitted fabric formed using a modified polyester fiber yarn and a spun yarn may also be preferably used. Such a fabric may have the same constitution as mentioned above with respect to the fabric containing a multifilament yarn. As the spun yarn, conventional spun yarns of any of natural fibers and man-made fibers can be used. Preferably, there may be exemplified spun yarns composed of an ultra-fine fiber having a single fiber denier of not more than 1.2 deniers, more preferably not more than 1.0 denier. In addition to the spun yarn composed exclusively of the ultra-fine fiber, there may also be used a blended spun yarn containing the ultra-fine fiber along with another fiber. As the other fiber, there may be exemplified conventional fibers for clothing having a single fiber denier ranging from 1.5 to 4.0 deniers. Preferably, the blended spun yarn contains the ultra-fine fiber in an amount of 20 to 80% by weight based on the total weight of the yarn. Furthermore, the blended spun yarn preferably has a cotton count of from 16 to 60.

In the preparation of the fabric according to the present invention, after forming a fabric, the fabric is applied with a fluorine type water and oil-repellency agent at least one surface. Where a fabric containing an ultra-fine fiber is used, prior to the application of the water and oil-repellency agent, the fabric may advantageously be subjected to heat treatment to predominantly arrange the ultra-fine fiber in the surface area of the fabric, and then, to calendering to impart smoothness onto the surface despite of the fine irregularity due to the existence of the ultra-fine fiber. Further, the fabric may be subjected to raising to raise the ultra-fine fiber arranged in the surface area by the heat treatment and, thus, cover at least one surface with the raised ultra-fine fiber, prior to the application of the water and oil-repellency agent.

The fabric of the present invention is different from a conventional product formed by treatment with an antistatic agent and a water-repellency agent, in which both the antistatic agent and the water-repellency agent are copresent in the fabric to obtain the effects of both the agents. Namely, in the fabric of the present invention, since the antistatic agent is blended in the interior of the fiber, a durable antistatic effect can be obtained. Furthermore, since the surface of the fabric is covered with the fluorine type water and oil-repellency agent as the water-repellency agent, the fluorine type water and oil-repellency agent is not influenced by the hydrophilic antistatic agent and its effect is sufficiently exerted. Especially, in the case where a modified polyester having a continuous hollow portion in the section thereof is used and the polyoxyalkylene glycol as the antistatic agent is used in combination with the ionic antistatic agent, there is brought about a peculiar distribution, deemed to be due to a certain bleed-out phenomenon, in which the ionic antistatic agent is substantially uniformly dispersed but the majority of the polyoxyalkylene glycol component is agglomerated in the portion surrounding the hollow portion. By this peculiar distribution, even if the amount of the ionic antistatic agent is reduced, an excellent antistatic effect can be attained. By applying the water repellent to this modified polyester fiber having a hollow portion, both the antistatic property and the water-repellent property can be imparted to the fabric.

By using the above-mentioned modified polyester fiber, this antistatic property can be made durable. If the fluorine type water and oil-repellency agent is used in combination with the above-mentioned polyfunctinal aziridine compound and/or melamine derivative, an excellent durability can be imparted to the water repellency.

The present invention will now be illustrated by the following examples. In the examples, the measurements of the antistatic property and water repellency and washing for determining the washing resistance were carried out according to the following methods.

Antistatic Property

The frictional charge voltage (V) was measured in an atmosphere maintained at a temperature of 20° C. and a relative humidity of 50% by using a rotary static tester of Kyodai-Kaken type and a cotton fabric as the reference fabric.

Water Repellecy

The water repellency was measured according to the spray test method 5.2 of JIS L-1092.

Washing

By using a household washing machine and Super Zab (supplied by Kao Soap) as the detergent, the following washing cycle was repeated predetermined times:

washing (detergent concentration of 2 g/l, bath ratio of 1/30, 40° C., 10 minutes)→dehydration→water washing (bath ratio of 1/30, 2 minutes)→dehydration→water washing (bath ratio of 1/30, 2 minutes)→dehydration→air drying.

EXAMPLE 1

When a polyethylene terephthalate composition comprising 98.8 parts by weight of polyethylene terephthalate having an intrinsic viscosity of 0.65 as measured at 25° C. in o-chlorophenol and 1.2 parts by weight of a mixture containing polyoxyethylene glycol having an average molecular weight of 20,000 and sodium alkyl sulfonate having an average number of carbon atom of 12 of 13 at a ratio of 2:1 was melt-spun. The melt was extruded at a rate of 19.7 g/min from an orifice plate having 24 extrusion holes having a diameter of 1.0 mm and a slit width of 0.15 mm. The extrusion temperature was 295° C. and the spun fiber was taken up at a take-up speed of 1200 m/min. The obtained undrawn yarn had one continuous hollow portion at the center of the fiber, which was continuous in the direction of the fiber axis. In a drawing apparatus in which a feed roller maintained at 80° C., a groove non-contact type heater maintained at 210° C. and a take-up roller were arranged in this order, the undrawn yarn was drawn at a draw ratio of 2.95 between the feed roller and the take-up roller and taken up at a take-up roller speed of 500 m/min to obtain a drawn yarn having a fineness of 50.1 deniers, a strength of 4.2 g/de, an elongation of 42% and a hollow ratio of 1.7%.

A plain weave fabric was prepared by using this drawn yarn as the weft and a 50 de/24 fil regular polyester filament yarn as the warp, and the obtained green fabric was scoured, heat set and dyed according to customary procedures.

The fabric was immersed in the following padding bath containing a fluorine type water and oil-repellency agent and squeezed to a pick-up of 40% by a mangle.

Fluorine type water and oil-repellency agent (Asahi Guard AG710 supplied by Asahi Glass): 12%

Melamine resin (methoxylated trimethylol melamine, Sumitex Resin M-3 supplied by Sumitomo Kagaku): 0.3%

Aziridine compound (Chemitite DZ-22 supplied by Nippon Shokubai Kagaku Kogyo and containing 25% of

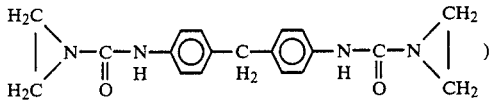

: 0.6%

Catalyst (Sumitex Accelerator ACX supplied by Sumitomo Kagaku): 0.1%

Then, the fabric was dried at 120° C. for 1 minute and heat treated at 170° C. for 1 minute.

COMPARATIVE EXAMPLE 1

A plain weave fabric was prepared in the same manner as described in Example 1 by using a 50 de/24 fil regular polyester filament yarn as the warp and weft, and the fabric was processed in the same manner as described in Example 1.

COMPARATIVE EXAMPLE 2

A woven fabric obtained by carrying out weaving, scouring, pre-heat-setting and dyeing in the same manner as in Comparative Example 1 was immersed in the following padding bath and squeezed to a pick-up of 40% by a mangle. Then, the fabric was dried at 120° C. for 1 minute and heat treated at 170° C. for 1 minute.

Fluorine type water and oil-repellency agent (Asahi Guard AG710 supplied by Asahi Glass): 12%

Melamine resin (methoxylated trimethylol melamine, Sumitex Resin M-3 supplied by Sumitomo Kagaku): 0.3%

Aziridine compound (Chemitite DZ-22 supplied by Nippon Shokubai Kagaku and containing 25% of

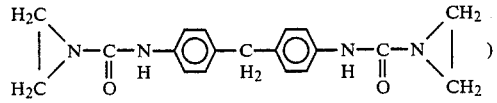

: 0.6%

Catalyst (Sumitex Accelerator ACX supplied by Sumitomo Kagaku): 0.1%

Antistatic agent (Nicepole TF-53 supplied by Nikka Kagaku): 0.5%

With respect to each of the woven fabrics obtained in Example 1 and Comparative Examples 1 and 2, the antistatic property and water repellency were measured. The obtained results are shown in Table 1.

TABLE 1

| | Frictional Charge Voltage (V) | | | Water Repellency (points) | | |
|---|---|---|---|---|---|---|
| | before washing | after 10 washings | after 20 washings | before washing | after 10 washings | after 20 washings |
| Example 1 | 1000 | 1100 | 1100 | 100 | 100 | 90–100 |
| Comparative Example 1 | 3500 | 4000 | 4000 | 100 | 100 | 90–100 |
| Comparative Example 2 | 205 | 3600 | 4100 | 100 | 70–80 | 50 |

In Comparative Example 1, the water repellency and its washing resistance were good, but no antistatic effect could be attained. In Comparative Example 2 where the antistatic agent was incorporated in the treating bath to obtain an antistatic effect, the antistatic property was good before washing but this antistatic property had no washing resistance. Furthermore, the water repellency was poor in the washing resistance. In contrast, in Example 1 of the present invention, both the antistatic property and the water repellency were at very good levels and were excellent in the washing resistance.

EXAMPLE 2

A mixture of 100 parts by weight of dimethyl terephthalate, 70 parts by weight of ethylene glycol and 0.025 part by weight of manganese acetate as a transesterification catalyst was heated under stirring while distilling off the formed methanol for 90 minutes to effect transesterification. Then, 0.015 part by weight of phosphorous acid as a stabilizer and 0.041 part by weight of antimony trioxide as a polycondensation catalyst were added, the mixture was heated to 285° C., and the polycondensation was carried out under a reduced pressure of 60 mmHg for 30 minutes and the under a highly reduced pressure of 0.5 mmHg for 80 minutes. After the completion of the polycodensation, 3 parts by weight of polyoxyethylene glycol of an average molecular weight of 10,000 and 3 parts by weight of sodium dodecyl sulfonate were mixed with the resultant polymer to obtain a polyethylene terephthalate composition having an intrinsic viscosity of 0.65 as measured in o-chlorophenol at 25° C.

The obtained composition was converted into chips and, after drying, spun into filaments at a spinning temperature of 290° C. and a take-up speed of 1,500 m/min. The filaments were drawn at 85° C. and a draw ratio of 3.2 to obtain a solid modified polyester multifilament of 50 de/24 fil. A plain weave fabric was formed using the obtained modified polyester multifilament as the weft and an ordinary polyester multifilament of 50 de/24 fil as the warp. The fabric was scored, heat set and dyed in a conventional manner. Then, the fabric was immersed into a padding bath having the same composition as described in Example 1, squeezed into a pick-up of 45% on a mangle. The fabric was dried at 120° C. for 1 minute, and heat treated at 170° C. for 1 minute.

The obtained fabric was then subjected to the measurement of the antistatic property and water repellency. The results are shown in Table 2 below.

TABLE 2

| | Frictional Charge Voltage (V) | | | Water Repellency (points) | | |
|---|---|---|---|---|---|---|
| | before washing | after 10 washings | after 20 washings | before washing | after 10 washings | after 20 washings |
| Example 2 | 800 | 900 | 900 | 100 | 90-100 | 90 |

EXAMPLE 3

When a polyethylene terephthalate composition comprising 98.8 parts by weight of polyethylene terephthalate having an intrinsic viscosity of 0.65 as measured at 25° C. in o-chlorophenol and 1.2 parts by weight of a mixture containing polyoxyethylene glycol having an average molecular weight of 20,000 and sodium dodecyl benzene sulfonate having an average number of carbon atom of 12 to 13 at a ratio of 2:1 was melt-spun. The melt was extruded at a rate of 19.7 g/min from an orifice plate having 24 extrusion holes having a diameter of 1.0 mm and a slit width of 0.15 mm. The extrusion temperature was 295° C. and the spun fiber was taken up at a take-up speed of 1200 m/min. The obtained undrawn yarn had one continuous hollow portion at the center of the fiber, which was continuous in the direction of the fiber axis. In a drawing apparatus in which a feed roller was set at 80° C., the feed roller and a take-up roller were arranged in this order, the undrawn yarn was drawn at a draw ratio of 2.95 between the feed roller and the take-up roller and taken up at a take-up roller speed of 500 m/min to obtain a high shrinkage drawn yarn having a finess of 50.2 denier, a strength of 4.2 g/de, an elongation of 45%, a hollow ratio of 1.7% and a boiling water shrinkage of 15%.

A high density plain weave fabric having a total cover factor (warp and weft) of 2,071, a warp density of 184/3.79 cm and a weft density of 104/3.79 cm was prepared by using a mixed multifilament yarn made from the obtained modified polyester multifilament yarn and an ultra-fine polyethylene terephthalate multifilament yarn of 64 de/144 fil and having a boiling water shrinkage of 8%. The fabric was subjected to scoring, reluxing, drying, pre-heat-setting, dyeing and drying according to conventional process. However, the scoring and reluxing were carried out under a tension as low as possible so as to fully develop the shrinkage difference between the component filaments.

The fabric was then subjected to water repellent treatment using the following treating composition:

Asahi Guard AG710: 6%
Unika Resin 380K (Union Kagaku): 0.3%
Sumitex Accelarator ACX: 0.1%
Water: 93.6%

The fabric was applied with the treating liquid composition by padding to a pick-up of 48%, dried at 100° C., and then heat treated at 180° C. for 30 seconds.

COMPARATIVE EXAMPLE 3

The procedure as in Example 3 was repeated except that a mixed multifilament yarn made from an ordinary polyethylene terephthalate multifilament yarn of 50 de/24 fil and having a boiling water shrinkage of 17% and an ultra-fine polyethylene terephthalate multifilament yarn of 64 de/144 fil and having a boiling water shrinkage of 8% was used.

The antistatic property and water repellency of the fabrics obtained in Example 3 and Comparative Example 3 were measured. The results are shown in Table 3 below.

TABLE 3

| | Frictional Charge Voltage (V) | | Water Repellency (points) | |
|---|---|---|---|---|
| | before washing | after 5 washings | before washing | after 5 washings |
| Example 3 | 1100 | 1200 | 100 | 100 |
| Comparative Example 3 | 3800 | 4200 | 100 | 100 |

EXAMPLE 4

A hollow composite fiber was prepared according to the procedure as described in Japanese Unexamined Patent Publication (Kokai) No. 51-70366, using polyethylene terephthalate having an intrinsic viscosity of 0.62 as measured at 35° C. in o-chlorophenol and poly-ε-caproamide having an intrinsic viscosity of 1.30 as measured at 35° C. in methacresol. The composite fiber had a configuration in which 8 polyester component portions and 8 polyamide component portions were alternately and adjacently arranged in a circular form and extended along the fiber axis to form a cylindrical body as a whole. The composite fiber had a ratio by weight of the polyester component portions to the polyamide component portions of 1:1, and each of the portions had a fineness of 0.32 denier and the composite fiber itself had a fineness of 3.7 deniers. The hollow ratio (i.e., the proportion of the volume of the hollow portion to the total volume of the whole polyester component and polyamide component portions and the hollow portion) was 8%.

A plain weave fabric was prepared using the obtained hollow composite multifilament yarn of 75 de/20 fil as the weft and a modified polyester multifilament yarn of 50 de/24 fil as obtained in Example 1 as the warp. The fabric was immersed in a 1% emulsion of Tetrosin OEN (containing 36% of o-phenylphenol, supplied by Yamakawa Yakuhin) at a goods to liquor ratio of 30:1 at 30° C. for 30 minutes. The fabric was soaped in an aqeous bath containing 0.5% of soda ash and 1 g/1 of Scoreroll 400 (supplied by Kao Atlas) at 90° C. for 20 minutes, and then heat set and dyed in a conventional manner. The fabric was then treated as described in Example 2.

COMPARATIVE EXAMPLE 4

By repeating procedure as in Example 4, except that an ordinary polyester multifilament yarn of 50 de/24 fil was used as the warp, a fabric was formed and dyed. The dyed fabric was then immersed into a padding bath as described in Example 2, squeezed to a pick-up of 45% and heat treated at 120° C. for 1 minute and at 170° C. for 1 minute.

The measured antistatic property and water repellency of the fabrics obtained in Example 4 and Comparative Example 4 are shown in Table 4 below.

TABLE 4

| | Frictional Charge Voltage (V) | | Water Repellency (points) | |
|---|---|---|---|---|
| | before washing | after 20 washings | before washing | after 20 washings |
| Example 4 | 1100 | 1100 | 100 | 100 |
| Comparative Example 4 | 500 | 4300 | 100 | 80 |

EXAMPLE 5

A plain fabric was prepared using a modified polyester multifilament yarn of 50 de/24 fil as the warp and a spun yarn of 50 S/1 as the weft. The spun yarn was prepared by spinning together polyester staple fibers having a single fiber denier of 0.8 denier and a length of 38 mm and polyester staple fibers having a single fiber denier of 1.3 deniers and a length of 38 mm at a mixing ratio of 1:1. The fabric was scored and dyed in a conventional manner, and treated with a water repellent-imparting composition as described in Example 3.

The obtained fabric had a good antistatic property as having a frictional charge voltage of 900 to 1,000 V and a high water repellency as being at a level of 100 points both before washing and after 5 washings.

We claim:

1. An antistatic polyester fabric having a water repellency, which comprises a fabric comprising a fiber of a modified polyester composed mainly of a polyester and blended with an antistatic agent, at least the surface of which is covered with a fluorine type water and oil-repellency agent.

2. A fabric as set forth in claim 1, wherein the antistatic agent comprises a polyoxyalkylene having no substantial reactivity with the polyester and an ionic antistatic agent, and the content of the antistatic agent is at most 3% by weight.

3. A fabric as set forth in claim 1, wherein the modified polyester fiber has a hollow portion continuous in the longitudinal direction thereof.

4. A fabric as set forth in claim 3, wherein the antistatic agent is dispersed at a high concentration in a portion surrounding said hollow portion.

5. A fabric as set forth in claim 1, wherein said fabric comprises the modified polyester fiber in combination with an ultra-fine fiber.

6. A fabric as set forth in claim 5, wherein the modified polyester fiber is combined with the ultra-fine fiber by forming a mixed yarn of a modified polyester multifilament yarn and an ultra-fine multifilament yarn.

7. A fabric as set forth in claim 5, wherein the modified polyester fiber is combined with the ultra-fine fiber by forming a mixed woven or knitted fabric.

8. A fabric as set forth in claim 1, wherein said fabric comprises the modified polyester fiber in combination with a staple fiber in the form of a spun yarn.

9. A fabric as set forth in claim 8, wherein said staple fiber comprises an ultra-fine fiber.

* * * * *